US006146550A

United States Patent [19]

Le Boulch et al.

[11] Patent Number: 6,146,550

[45] Date of Patent: Nov. 14, 2000

[54] ELECTRICAL RESISTANCE HEATING ELEMENT FOR AN ELECTRIC FURNACE AND PROCESS FOR MANUFACTURING SUCH A RESISTANCE ELEMENT

[75] Inventors: Marianne Le Boulch, Saint Mammes; Thierry Chartier, Feytiat; Jean-Marc Laurent, Saint Amand Montrond; Patrice Goeuriot, Monistrol sur Loire; François Valdivieso, Saint Etienne, all of France

[73] Assignee: Electricite de France-Service National, Paris, France

[21] Appl. No.: 09/343,204

[22] Filed: Jun. 30, 1999

[30] Foreign Application Priority Data

Jul. 6, 1998 [FR] France ..... 98 08634

[51] Int. Cl.[7] ..... H01B 1/04; H05B 3/10

[52] U.S. Cl. ..... 252/516; 264/104; 219/553

[58] Field of Search ..... 252/516, 521.2; 219/552, 553, 541; 264/66, 104

[56] References Cited

U.S. PATENT DOCUMENTS 4,174,971 11/1979 Schrewelius ..... 106/44

FOREIGN PATENT DOCUMENTS 180 928 5/1986 European Pat. Off. .

2 575 458 7/1986 France .

2 757 736 6/1998 France .

1636400 3/1991 U.S.S.R. .

93 14 044 7/1993 WIPO .

OTHER PUBLICATIONS

Patent Abstracts of Japan, vol. 17, No. 340 (E–1389), Jun. 28, 1993 & JP 05 047455 A (Nippon Pillar Packing Co. Ltd), Feb. 26, 1993.

Soviet Patents Abstracts, Week 9230, Derwent Publications Ltd., London, GB, AN 92–248581 XP002097184, & SU 1 685 752 A (Tern Education Inst.) May 29, 1989.

Japanese Patent Gazette, Week 8512, Derwent Publications Ltd., London, GB, AN 85–072413, XP002097185 & JP 60 027653 A (Hitachi Ltd.) Jul. 21, 1983.

Hashiguchi et al "Electrical Resistivity of α–SiC Ceramics with added NiO" J. Ceram. Soc. Jpn. (1994) 102 (Feb.), 160–4, 1994.

*Primary Examiner*—Mark Kopec

*Attorney, Agent, or Firm*—Sughrue, Mion, Zinn, Macpeak & Seas, PLLC

[57] ABSTRACT

This electrical resistance heating element (10) for an electric furnace comprises a resistive heating part (12) made of a ceramic. The ceramic comprises a sintered mixture of silicon carbide particles, of dopant particles, suitable for obtaining an electrically conductive phase after sintering, and of mineral particles.

10 Claims, 1 Drawing Sheet

| | | |
|---|---|---|
| Free $SiO_2$: 0.8% | Fe(ppm) : 100 | Cr(ppm) : 10 |
| Free Si: 0.03% | Al(ppm) : 600 | Ca(ppm) : 40 |
| Free C: 0.25% | Ni(ppm) : 10 | Ti(ppm) : 00 |
| SiC: 98,8% | V(ppm) : 120 | Mg(ppm) :<100 |
| | Na(ppm) : 200 | |

ELECTRICAL RESISTANCE HEATING ELEMENT FOR AN ELECTRIC FURNACE AND PROCESS FOR MANUFACTURING SUCH A RESISTANCE ELEMENT

BACKGROUND OF THE INVENTION

The present invention relates to an electrical resistance heating element for an electric furnace, as well as to a process for manufacturing such a resistance element.

Electrical resistance heating elements are produced, for example, by sintering ceramic particles, and particularly silicon carbide particles.

Silicon carbide, which is used widely for the manufacture of such heating elements, allows relatively robust resistance elements having excellent thermal properties to be obtained.

Nevertheless, such resistance elements have drawbacks in the case of their use at high temperature and in an oxidizing atmosphere, insofar as the silicon carbide particles are able to oxidize relatively rapidly in the presence of oxygen.

Such oxidation is accompanied by a not insignificant change in the value of the resistivity, this having to be compensated for by increasing their supply voltage.

The rapid oxidation of current silicon carbide resistance elements is firstly due to their considerable porosity, which facilitates the reaction between oxygen and silicon carbide.

The premature ageing of such resistance elements is also due to the nature of the components added to the silicon carbide which produce, at high temperature, a low-viscosity secondary phase. The oxygen can then easily diffuse into the core of the material and oxidize the heating element.

SUMMARY OF THE INVENTION

The object of the invention is to alleviate these drawbacks.

The subject of the invention is therefore an electrical resistance heating element for an electric furnace, comprising a resistive heating part made of a ceramic, characterized in that the ceramic comprises a sintered mixture of silicon carbide particles, of dopant particles, suitable for obtaining an electrically conductive phase after sintering, and of mineral particles.

The resistivity of the resistance element is thus specifically controlled and its porosity is considerably reduced.

The electrical resistance element according to the invention may furthermore include one or more of the following characteristics, taken in isolation or in any technically possible combination:

- the mineral particles comprise alumina and yttrium oxide and the dopant particles comprise nickel oxide;
- the size of the silicon carbide particles is between 0.5 and 20 microns;
- the resistance element furthermore comprises at least one terminal for electrically connecting and mechanically fastening the resistance element, extending at least one corresponding end zone of the resistive heating part and comprising a sintered mixture of silicon carbide particles, of mineral particles and of dopant particles suitable for obtaining an electrically conductive phase after sintering;
- the electrical connection terminal has a higher concentration of dopant particles than that of the heating part; and
- as a variant, the connection terminal has a cross section of larger dimensions than that of the resistive heating part.

The subject of the invention is also a process for manufacturing a ceramic resistance heating element for an electric furnace, characterized in that it comprises the steps of:

- preparing a mixture of silicon carbide particles, dopant particles and mineral particles;
- adding at least one organic material to the mixture prepared;
- forming the resistance element by extrusion;
- heat-treating the resistance element formed, for the purpose of removing the said at least one organic material; and
- sintering the resistance element formed, the dopant particles being suitable for obtaining an electrically conductive phase after sintering.

The process according to the invention may furthermore comprise one or more of the following characteristics:

- the step of adding organic material consists in adding at least one binding element, at least one plasticizing element and at least one lubricating element to the mixture of particles;
- during the step of forming the resistance element, at least one electrical-connection and mechanical-fastening terminal is formed by increasing the cross section of at least one corresponding end zone of the resistance element;
- as a variant, at least one electrical-connection and mechanical-fastening terminal is formed by reducing the cross section of the central part of the resistance element.

BRIEF DESCRIPTION OF THE DRAWINGS

Further characteristics and advantages will emerge from the following description, given solely by way of example, and with reference to the appended drawings in which.

DESCRIPTION OF PREFERRED EMBODIMENTS

Figures 1, 2:
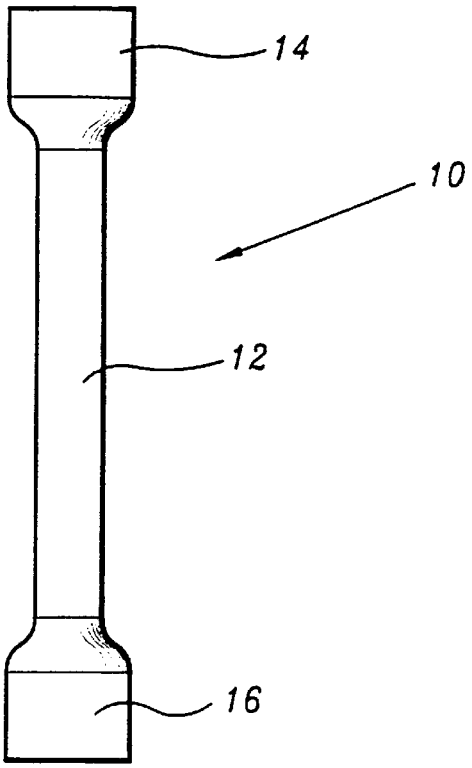
FIG. 1 is a diagrammatic side view of an electrical resistance heating element according to the invention.
FIG. 2 is a table illustrating the composition of a ceramic used in the construction of the resistance element in FIG. 1.

FIG. 1 shows an electrical resistance heating element according to the invention, denoted by the general numerical reference 10.

The resistance element shown in this figure has a cylindrical general shape, however the invention also applies to the manufacture of resistance heating elements of any shape, especially tubular, straight or angled resistance elements.

The resistance element 10 essentially comprises a heating body 12 provided with one or two (as shown) mutually opposed end zones 14 and 16 forming mechanical-fastening and electrical-connection terminals.

The terminals 14 and 16 have a lower resistance than that of the heating body 12 and are either formed by machining the body or produced by adding a cylinder to one or each end of the body 12 and welding it.

The resistance element 10 is produced by sintering a ceramic.

More particularly, the resistive part 12 comprises a sintered mixture of silicon carbide particles, of dopant particles, suitable for obtaining an electrically conductive phase, which consist of nickel oxide, and of mineral particles, for example alumina and yttrium oxide particles, allowing liquid-phase sintering of the silicon carbide particles.

In order to improve the density of the resistance element, and therefore to reduce its porosity, the silicon carbide particles have a size of between 0.1 and 20 microns, preferably equal to 1.5 microns.

For example, the silicon carbide particles form two populations, the size distributions of which are centred on 1 $\mu$m and 10 $\mu$m, respectively, the size distribution of the nickel oxide particles being centred on 0.5 $\mu$m.

Advantageously, these silicon carbide particles consist of commercial silicon carbide, for example of the FCP type, sold by Norton, USA, in the form of powder, the composition of which is illustrated in the table presented in FIG. 2.

The terminals 14 and 16 for electrically connecting and mechanically fastening the resistance element 10 also consist of a sintered mixture of silicon carbide particles and of mineral particles, which are identical to the particles used in the composition of the resistive heating part 12 and have a higher concentration of dopant particles resulting in an electrically conductive phase than that of the heating part.

As a variant, and as may be seen in FIG. 1, it is possible to form the terminals 14 and 16, as described below, by forming the latter during the manufacture of the heating part 12, by providing end zones having a cross section of larger dimensions than that of the resistive heating part 12, these end zones either being obtained by machining the central part of the resistance element so as to reduce its cross section or, as mentioned above, being fitted onto the ends of the body 12.

In order to manufacture the resistance element illustrated in FIG. 1, the first step consists of a step of preparing the raw materials.

To do this, for example, as mentioned above, Norton FCP powder, additives consisting of mineral particles, namely alumina $Al_2O_3$ and yttrium oxide $Y_2O_3$, and dopant particles, namely nickel oxide NiO, resulting in an electrically conductive phase, are mixed with silicon carbide.

For example, these additives are made into a homogeneous mixture in the following proportions:

silicon carbide: 90 to 99% by weight, alumina: 0.45 to 5% by weight, yttrium oxide: 0.3 to 3% by weight and nickel oxide: 0.25 to 4% by weight, this depending on the temperature at which a subsequent heat-treatment step is carried out in order to sinter the resistance element, and depending on the desired properties of the end-product, the balance consisting of a solvent suitable for the intended use.

The mixture thus formed is then dried, by putting it into an oven at 80° C., or by spray drying it, until the solvent has completely evaporated.

During the next manufacturing phase, the resistance element is formed using an extrusion technique.

To do this, organic constituents are used so as to form a paste having Theological properties compatible with deformation on passing through a die of an extruder and with good mechanical integrity of the extruded elements before firing.

The organic constituents comprise, prepared beforehand in the form of a gel, for example a methyl cellulose binder, a plasticizer, for example liquid paraffin, and lubricants, for example an amine and oleic acid, and are incorporated into the mixture, consisting of the silicon carbide, the mineral particles and the dopant particles, during a mixing step which is maintained, for example, for one hour.

The various constituents mentioned above are introduced in the following proportions:

methyl cellulose gel: 2% by weight of methyl cellulose, liquid paraffin: 3 to 7% by weight, rhodamine: 0.25 to 1% by weight and oleic acid: 0.25 to 1% by weight.

At the end of this step, a homogeneous paste is obtained which is left to stand until it becomes perfectly homogeneous.

Next, the paste is extruded using an extruder, so as to form cylindrical bars.

The next manufacturing phase starts with a first heat-treatment step for the purpose of removing the organic constituents.

To do this, the bars are placed in the ambient air and firstly heated, at a rate of 30° C. per hour, from 20° C. to 150° C. and then held at this temperature for one hour. Next, the temperature is raised, again at a rate of 30° C. per hour, from 150° C. to 300° C. and then maintained at this temperature of 300° C. for one hour. The bars are then heated a third time by raising the temperature to 450° C., at a rate of 30° C. per hour. The bars are maintained at this final temperature for one hour and then left to cool down to room temperature.

Next, the bars thus obtained are put into another furnace in order to carry out the final sintering heat treatment itself.

Because of the use of mineral particles, it is possible to sinter the silicon carbide particles in the liquid phase, by forming a phase consisting of $Al_5Y_3O_{12}$ (YAG or yttrium aluminium garnet). Thus, this liquid phase impregnates all the silicon carbide particles, thereby considerably reducing the porosity and increasing the oxidation resistance.

Moreover, because of the presence of nickel oxide, a conductive second phase consisting of $Ni_3Si_2$ is formed, which gives the heating part a suitable resistivity value over a wide temperature range.

The sintering is carried out, on the one hand, in vacuo, by raising the temperature from 20° C. to 900° C., at a rate of 300° C. per hour, and then in argon, at a pressure of one bar, by raising the temperature from 900° C. to 2000° C., at a rate of 300° C. per hour, maintaining the temperature at 2000° C. for two hours, and, finally, allowing the resistance element to cool down to room temperature. Another inert gas, for example nitrogen, may also be used.

As mentioned above, and as may be seen in FIG. 1, the heating part 12 is extended, on at least one of its ends, by an electrical-connection and mechanical-fastening terminal 14 and 16 which is either fitted by adding a cylinder to the end of the bars and welded to the resistive heating part 12, or is machined after extrusion, or is formed simultaneously during the same extrusion step by providing corresponding end zones having a cross section of dimensions greater than that of the heating part 12.

Of course, if the connection terminals 14 and 16 are fitted, it is possible to form the fitted part or parts by using a higher concentration of dopant particles resulting in an electrically conductive phase than that of the resistive heating part 12.

What is claimed is:

1. Electrical resistance heating element for an electric furnace, comprising a resistive heating part (12) made of a ceramic, characterised: in that the ceramic comprises a sintered mixture of silicon carbide particles, of dopant particles for obtaining an electrically conductive phase after sintering, and of mineral particles; in that the mineral particles comprise alumina and yttrium oxide; and in that the dopant particles comprise nickel oxide.

2. Resistance heating element according to claim 1, characterized in that the size of the silicon carbide particles is between 0.1 and 20 microns.

3. Resistance heating element according to claim 1, characterized in that it furthermore comprises at least one terminal (14, 16) for electrically connecting and mechanically fastening the resistance element (10), extending at least one corresponding end zone of the resistive heating part (12) and comprising a sintered mixture of silicon carbide particles, of mineral particles and of dopant particles for obtaining an electrically conductive phase after sintering.

4. Resistance heating element according to claim 3, characterized in that the electrical connection terminal (14, 16) has a higher concentration of dopant particles than that of the resistive heating part.

5. Resistance heating element according to claim 3, characterized in that the connection terminal (14, 16) has a cross section of larger dimensions than that of the resistive heating part (12).

6. Process for manufacturing a ceramic resistance heating element for an electric furnace, characterized in that it comprises the steps of:

preparing a mixture of silicon carbide particles, dopant particles and mineral particles, wherein said dopant particles comprise nickel oxide and said mineral particles comprise alumina and yttrium oxide;

adding at least one organic material to the mixture prepared;

forming the resistance element by extrusion;

heat-treating the resistance element formed, for removing the said at least one organic material; and sintering the resistance element formed, the said dopant particles being suitable for obtaining an electrically conductive phase after sintering.

7. Process according to claim 6, characterized in that the size of the silicon carbide particles is between 0.1 and 20 microns.

8. Process according to claim 6, characterized in that the step of adding organic material consists in adding at least one binding element, at least one plasticizing element and at least one lubricating element to the mixture of particles.

9. Process according to claim 6, characterized in that, during the step of forming the resistance element, at least one electrical-connection and mechanical-fastening terminal is formed by increasing the cross section of at least one corresponding end zone of the resistance element.

10. Process according to claim 6, characterized in that, during the step of forming the resistance element, at least one electrical-connection and mechanical-fastening terminal is formed by reducing the cross section of the central part of the resistance element.

* * * * *